US007217909B2

(12) United States Patent
Fusejima et al.

(10) Patent No.: US 7,217,909 B2
(45) Date of Patent: May 15, 2007

(54) MICROWAVE BAKING FURNACE

(75) Inventors: Junichi Fusejima, Tochigi (JP); Yoshihiro Hisamatsu, Tochigi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/105,379

(22) Filed: Apr. 14, 2005

(65) Prior Publication Data

US 2005/0230386 A1 Oct. 20, 2005

(30) Foreign Application Priority Data

Apr. 16, 2004 (JP) ..... 2004-121376

(51) Int. Cl.
*H05B 6/70* (2006.01)

(52) U.S. Cl. ..... 219/756; 219/759; 219/762

(58) Field of Classification Search ..... 219/756, 219/685, 715, 738, 749, 759, 762, 748, 750; 426/292, 646, 296, 652, 575, 241; 99/476, 99/275, 771, 710, 680–681
See application file for complete search history.

(56) References Cited

U.S. PATENT DOCUMENTS 3,320,396 A * 5/1967 Helmut ..... 219/685
6,163,020 A * 12/2000 Bartusch et al. ..... 219/756

FOREIGN PATENT DOCUMENTS

| | | |
|---|---|---|
| JP | 02-275777 | 11/1990 |
| JP | 06-345541 | 12/1994 |
| JP | 07-318262 | 12/1995 |
| JP | 2002-130960 | 9/2002 |

* cited by examiner

*Primary Examiner*—Quang Van
(74) *Attorney, Agent, or Firm*—McDermott Will & Emery LLP

(57) ABSTRACT

A microwave baking furnace is provided including a metallic cavity irradiated with microwaves; a baking chamber provided in the cavity and surrounded by a heat insulating member having a low microwave absorption characteristic and a high heat insulating property, which is disposed in the cavity; and a microwave generator. Substances having a high microwave loss are arranged in weak microwave electric field areas in the baking chamber at a distance, which exceeds ¼λ of a wavelength λ of microwaves to be used, from the metallic cavity. The microwave baking furnace can efficiently implement a temperature rise in a low temperature range and a temperature rise in a high temperature range only by microwave heating, can effectively prevent the occurrence of a temperature gradient in an object to be baked during a baking process, and is stable in supply of microwaves and is simply structured.

5 Claims, 4 Drawing Sheets

MICROWAVE BAKING FURNACE

BACKGROUND OF THE INVENTION

1. Field of the Invention

The present invention relates to a microwave baking furnace that bakes an object to be baked which is made of pottery materials, fine ceramics materials, etc. to produce a baked object.

2. Description of the Related Art

Recently, a technique that bakes pottery materials or fine ceramics by microwave heating has been suggested, and has already been put to practical use.

There are various types of microwave baking furnaces for microwave baking of ceramics, for example, a type in which an object to be baked such as ceramics self-heats by microwaves to bake itself and a type in which a heating material that generates heat by microwaves is disposed near an object to be baked and the object to be baked is baked by heat generated by the heating material. Japanese Patent Laid-Open No. 6-345541 (Pages 2 and 3, FIG. 1 discloses the former type of baking furnace.

As the latter type of microwave baking furnace, a baking furnace whose inner peripheral walls are made of a heating material that self-heats by microwaves is suggested (see Japanese Patent Laid-Open No. 2-275777 (Page 3, FIG. 1)). This baking furnace includes a cylindrical container made of a microwave-transmittable heat insulating member are received within a microwave oven and a cylindrical element made of a baked silicon carbide material and disposed in the container. In this baking furnace, using the inside of the cylindrical element as a baking portion, an object to be baked is put into the baking portion, and microwaves are radiated to the baked silicon carbide material, which causes it to generate heat to bake the object to be baked.

As a baking furnace employing both types together, a baking furnace is suggested (see Japanese Patent Laid-Open No. 7-318262 (Page 3, FIG. 1)) which includes a heating container composed mainly of a substance having a high microwave loss; a heat insulating member covering the outside of the heating container and composed mainly of a substance having a low microwave loss; an opening formed in the heating container; and a microwave radiating device that radiates microwaves into the heating container via the heat insulating member and to an object to be baked in the heating container via the opening in the heating container. In this baking furnace, the temperature distribution in the thickness direction can be made flatter.

When a homogenous object is baked by microwave heating, theoretically, every part of the object to be baked is heated uniformly by microwaves. However, during baking process, since the atmospheric temperature of the microwave baking furnace is much lower than the surface temperature of the object to be baked, the object to be baked radiates heat from its surfaces. Consequently, a temperature gradient is caused between the central portion and the surfaces of the object to be baked, which is likely to induce cracks in the object to be baked.

Moreover, as a characteristic of microwave heating, if an object to be baked is made of the same material, a portion of the object having a higher temperature has a larger dielectric loss. Therefore, once a temperature gradient is caused, the microwave absorption rate of a portion having a higher temperature increases, and thus microwave absorption rates vary considerably from portion to portion, which causes local heating of the object. In this way, once a temperature gradient is caused, temperatures vary considerably from portion to portion by microwave heating, which promotes cracks in the object to be baked.

Further, when alumina, silica, etc., a main material of ceramics having a low dielectric loss at room temperature, is used as a raw material of an object to be baked during baking by microwave heating, there is a problem in that the energy effect of microwave heating in a low temperature range is low.

Thus, as a microwave baking furnace which can suppress the occurrence of a temperature gradient to reduce the occurrence of crack, as shown in FIG. 7, a microwave baking furnace having a heater 18 disposed therein to control the temperature of the microwave baking furnace is suggested (see Japanese Patent Laid-Open No. 6-345541)).

Moreover, a baking furnace, as shown in FIG. 8, including a baking chamber 26 partitioned to surround a whole object 20 to be baked with a blanket 19 that can self-heat by microwaves and microwave generating means 22 that radiate microwaves to the object to be baked disposed in the baking chamber 26, is suggested (see Japanese Patent Laid-Open No. 2002-130960 (Page 3, FIG. 1)). In such a baking furnace, heating value per unit volume by microwaves of the blanket is larger than that of the object to be baked, and the inner surface temperature of the blanket is substantially equal to that of the object to be baked.

This furnace is considered to be devised from an idea that, when an object is baked by microwaves, the object to be baked can be almost completely insulted from heat by completely surrounding the object to be baked with the blanket having microwave absorption characteristics equivalent to those of the object to be baked. In this case, the occurrence of heat gradient in the object can be prevented by radiation cooling, and the object can be baked more uniformly. However, when the object to be baked is baked while being surrounded by the blanket, microwave energy is absorbed by the blanket as well as the object to be baked. Therefore, there is a problem in that the amount of energy required for baking is considerably increased.

When the thickness of the blanket is made small to decrease the amount of energy consumed by the blanket, the blanket loses more thermal energy than that it obtains by microwaves. Therefore, a large temperature difference is caused between the inner surfaces of the blanket and the object to be baked. In order to solve the problem, it is sought not only to decrease the amount of energy required for baking the object to be baked but also to prevent the occurrence of a temperature gradient due to radiation cooling in the object to be baked.

In this furnace, the problem has been solved by making heating value per unit volume by microwave of the blanket larger than that of the object to be baked, and by making the temperature of the inner surfaces of the blanket equal to the surface temperature of the object to be baked.

In the microwave baking furnace additionally including a heater 18 that can implement a heat treatment independently, such as the microwave baking furnace disclosed in Japanese Patent Laid-Open No. 6-345541 (Pages 2 and 3, FIG. 1), since the heater 18 supplementarily heats the object in a low temperature range in which the energy effect of microwave heating is low, an object having a low dielectric loss at room temperature can be baked, and the energy efficiency for baking can be improved.

Further, as described in Japanese Patent Laid-Open No. 2002-130960 (Page 3, FIG. 1), a heat insulating property around the baking chamber can be improved, and the occurrence of a temperature gradient due to heat radiation can be prevented by covering the blanket which defines the baking chamber with another blanket having an excellent heat insulating property.

However, the microwave baking furnace described in each Patent Document has a complex structure, and thus requires high manufacturing cost. In addition, in the microwave baking furnace described in Japanese Patent Laid-Open No. 2002-130960 (Page 3, FIG. 1), although an effect of suppressing the occurrence of a temperature gradient can be obtained to some extent, the energy efficiency in a low temperature range is rarely improved.

In a microwave baking furnace having a metallic cavity radiated with microwaves and a microwave generating means, a baking chamber that receives an object to be baked provided in the cavity is surrounded by a heat insulating member having a low microwave absorption characteristic and a high heat insulating property. A microwave baking furnace shown in FIG. 6 can be considered as the microwave baking furnace which has the above structure and high efficiency.

The microwave baking furnace shown in FIG. 6 bakes pottery materials or fine ceramics by microwave heating, and includes a cavity that defines a microwave space 2; a magnetron as a microwave generating means that is connected to the cavity 3 via a waveguide 4, and that radiates microwaves to the cavity 3; a microwave stirring means 7 that stirs microwaves radiated to the cavity 3; and a blanket 19 that is disposed in the cavity 3 to surround an object 11 to be baked.

The cavity 3 is adapted to reflect microwaves to the microwave space 2 at least at the inner surfaces thereof, and to prevent microwave leakage.

The microwave stirring means 7 includes stirring blades 8 disposed in the cavity 3; a driving motor 9 disposed outside the cavity 3; and a rotation transmitting shaft 10 that transmits the rotation of the driving motor 9 to the stirring blades 8, and stirs the atmosphere in the cavity 3 with the rotation of the stirring blades 8.

The blanket 19 partitions the baking chamber 12 in which the object 11 to be baked is to be disposed, and has a double layer structure of a heat insulating member 15*a* and a substance 15*b* having a high microwave loss.

The heat insulating member 15*a* is made of a material that not only insulates heat but also transmits microwaves, specifically, alumina fiber, foamed alumina, etc.

As shown in FIG. 9, the heat insulating member 15*a* can suppress heat radiation to the outside from the baking chamber 12 or the blanket 19 better as the thickness thereof increases.

In FIG. 9, a curved line F1 represents a heat radiation characteristic in a case in which the thickness of a heat insulating member 15*a* is small, and a curved line F2 represents a heat radiation characteristic in a case in which the thickness of a heat insulating member 15*a* is increased as compared to that in the curved line F1. It is evident from the drawing that the heat insulating member 15*a* having an increased thickness can improve the heat insulating property better. In FIG. 9, the horizontal axis represents the temperature of the baking chamber 12, and the vertical axis represents the amount of heat radiated from the blanket 19 to the outside.

The substance 15*b* having a high microwave loss is made of a dielectric material that self-heats by microwaves radiated from the outside and transmits some of the radiated microwaves to the object 11 to be baked in the baking chamber 12.

In this case, it is preferable that the substance 15*b* having a high microwave loss be made of one of silicon carbide, silicon nitride, graphite and composites containing these as main components.

Meanwhile, when the microwave baking furnace 1 shown in FIG. 6 bakes ceramics that is the object 11 to be baked by microwaves, the substance (silicon carbide, etc.) 15*b* having a high microwave loss covers six surfaces or all surfaces of the baking chamber 12 uniformly.

Also, when the substance 15*b* having a high microwave loss covers six surfaces or all surfaces of the baking chamber 12 uniformly, there is a problem in that the substance 15*b* having a high microwave loss is heated locally by microwaves and the object 11 to be baked or the heat insulating member 15*a* is broken irrespective of the existence of the microwave stirring means 7.

SUMMARY OF THE INVENTION

An object of the invention is to provide a microwave baking furnace which can efficiently implement all temperature range from a low temperature range to a high temperature range only by microwave heating, which can effectively prevent the occurrence of a temperature gradient in an object to be baked during a baking process, and, and which can decrease the manufacturing cost by stabilizing the supply of microwaves and simplifying its structure.

The inventor has carried out extensive researches to solve the above problems, and finds out that the occurrence of a temperature gradient in an object to be baked during a baking process can be prevented by arranging substances having a high microwave loss, such as silicon carbide having high heating value in a low temperature range on weak microwave electric field areas in a baking chamber at proper intervals, not by covering all parts of the baking chamber uniformly, and accomplishes the present invention based on the finding.

That is, an aspect of the invention is constructed as follows in order to solve the problems described above.

(1) A microwave baking furnace including a metallic cavity irradiated with microwaves; a baking chamber surrounded by a heat insulating member having a low microwave absorption characteristic and a high heat insulating property disposed in the cavity; and a microwave generating means, in which substances having a high microwave loss are arranged in weak microwave electric field areas of the baking chamber at a distance, which exceeds ¼ λ of the wavelength λ of microwaves to be used, from the metallic cavity.

(2) The microwave baking furnace according to (1), in which the substances having a high microwave loss are arranged on left, right, top and bottom of the baking chamber with a distance therebetween, in which the distance is equal to ½λ×n (n is a natural number) of the wavelength λ of the microwaves to be used.

(3) The microwave baking furnace according to (1), in which the substances having a high microwave loss are arranged inside a heat insulating member that transmits microwaves, and the heat insulating member is formed with holes or grooves to guide radiant heat from the substances having a high microwave loss to an outer wall of the baking chamber.

(4) The microwave baking furnace according to (1), in which holes or grooves to guide radiant heat from the substances having a high microwave loss to the inside of the baking chamber are formed and arranged on the outer wall of the baking chamber.

(5) The microwave baking furnace according to (1), in which the substances having a high microwave loss are arranged with an amount of less than 40 g/kW at their maximum microwave output.

(6) The microwave baking furnace according to (1), in which the substances having a high microwave loss are selected from one of silicon carbide, silicon nitride, graphite and composites containing these as main components.

In the present invention, an object is baked by microwave radiation from a low temperature range including room temperature to a high temperature range that is the baking temperature, and heating elements composed of a heating material having a high microwave loss are arranged in weak microwave electric field areas in the baking chamber.

In the baking furnace of the present invention, when a microwave generating means radiates microwaves, the heating elements and an object to be baked in the baking chamber, rise in temperature simultaneously by the microwaves that are transmitted through the partition wall.

During baking process described above, the substance having a high microwave loss composing the heating element generates heat at its inherent high energy efficiency until the temperature of the partition wall reaches a given temperature in a high temperature range, from the initial microwave heating, so as to raise the atmospheric temperature.

In the above heating process, the microwaves reflected from the metallic cavity are radiated to the substances having a high microwave loss, and thus part of the substances generates heat. Therefore, when the substances having a high microwave loss is located near the metallic cavity, since the amount of microwaves reflected from the metallic cavity considerably varies depending on the locations of the baking chamber, heating value may vary, and the temperature in the baking chamber may become non-uniform. Considering the above fact, in the present invention, the substances having a high microwave loss are arranged in weak microwave electric field areas at a distance, which exceeds ¼λ of a wavelength λ of microwaves to be used, from the metallic cavity, that is, to reduce factors in which the heating value considerably varies depending on the locations of the substances in the baking chamber, so that the temperature in the baking furnace is made uniform.

As a result, in the present invention, since the heating elements are arranged only in weak microwave electric field areas, radiant heat from the heating elements is not concentrated on the surface of an object to be baked, and thus the surface temperature of the object to be baked does not rise excessively. Also, since an object to be baked in the baking furnace is heated by microwaves transmitted through portions of the heat insulating member in which heating elements do not exist, and rises in temperature, the object to be baked is heated uniformly without causing a temperature difference between the surface and the inside of the object to be baked. Therefore, flaws or cracks due to any temperature difference do not occur in the object to be baked.

Moreover, in an aspect of the invention, it is preferable that the substances having a high microwave loss be arranged on the left, right, top and bottom of the baking chamber with a distance therebetween, in which the distance is equal to ½λ×n (n is a natural number) of a wavelength λ of microwaves to be used. As a result, the temperature of the baking chamber can be made more uniform.

According to the microwave baking furnace of the present invention, it is preferable that the substances having a high microwave loss that cover the baking chamber be arranged in weak microwave electric field areas at a distance, which exceeds ¼λ of a wavelength λ of microwaves to be used, from the metallic cavity. Therefore, the required amount of the substances having a high microwave loss such as silicon carbide that is expensive can be decreased, and thus the manufacturing cost of the furnace can be decreased. Also, a problem such as hot spots or spark due to the electric field concentration of microwaves can be solved.

Further, in the baking chamber, when the substances (heating elements) having a high microwave loss is disposed on the left, right, top and bottom of the baking furnace with a distance therebetween, in which the distance is equal to ½λ×n (n is a natural number) of the wavelength λ of the microwaves to be used, the temperature of the baking chamber can be made more uniform. Since an object to be baked is also directly heated by microwaves transmitted through clearances between the heating elements, and thus the object to be baked rises in temperature, no temperature difference between the surface and the inside of the object to be baked exists, and the occurrence of flaw can be prevented efficiently.

Moreover, when the heating elements are arranged inside the heating material, and the holes or the grooves that guide radiant heat from the heating elements to the baking wall are formed in the heat insulating member, since the radiant heat from the heating elements heated by microwaves can be efficiently guided to the inside of the baking furnace through the holes or the grooves, the temperature of the baking chamber can be raised uniformly and rapidly.

When the heating elements are arranged with an amount of less than 40 g/kW at their maximum microwave output, since the ratio in which microwaves heat the heating elements such as silicon carbide is not increased excessively, the use efficiency of microwaves can be maintained well without reducing the ratio of microwaves used for heating an object to be baked. Also, since the temperature of the baking chamber can be maintained uniformly, the occurrence of flaw can be prevented efficiently.

As described above, according to the present invention, when an object to be baked is heated, since the difference between the surface temperature and the inside of the object to be baked and the temperature in the microwave baking chamber can be decreased by controlling the temperature in the microwave baking chamber by microwave heating, the radiation of heat from the surface of the object to be baked can be decreased, the temperature distribution can be made uniform, and the temperature difference between respective portions of the object to be baked can be decreased. As a result, the occurrence of crack in can be prevented, and a high-quality baked object can be obtained.

DESCRIPTION OF THE PREFERRED EMBODIMENTS

Hereinafter, a microwave baking furnace according to preferred embodiments of the present invention will be described in detail with reference to the attached drawings.

Figure 1:
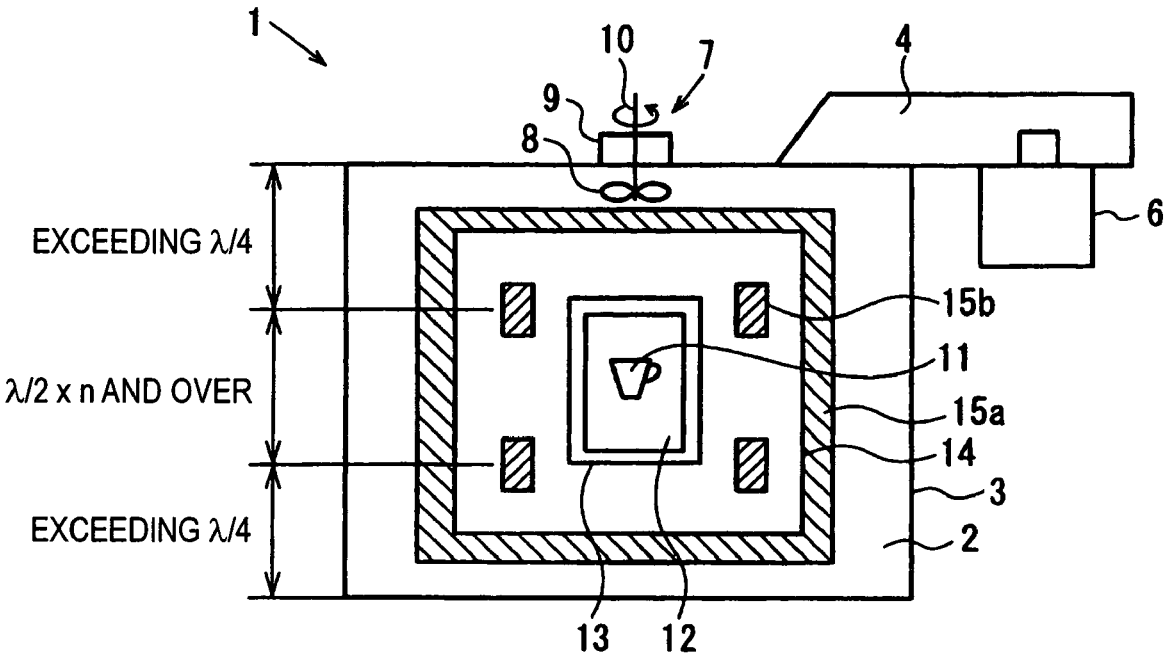
FIG. 1 is a schematic view illustrating the structure of a microwave baking furnace according to an embodiment of the present invention.

FIG. 1 illustrates a microwave baking furnace according to a first embodiment of the present invention.

A microwave baking furnace 1 in this embodiment bakes pottery materials or fine ceramics by microwave heating. The microwave baking furnace 1 includes a cavity 3 that defines a microwave space 2, a microwave oscillator (magnetron) 6 as a microwave generating means that is connected to the cavity 3 via a waveguide 4 and radiates microwaves into the cavity 3, a microwave stirring means 7 that stirs the microwaves radiated to the cavity 3, a partition wall 14 composed of a heat insulating member 15*a* disposed in the cavity 3 and transmitting microwaves, and substances (heating elements) 15*b* having a high microwave loss that generates heat by microwaves.

The cavity 3 is adapted to reflect microwaves to the microwave space 2 at least at the inner surfaces thereof and prevents microwave leakage.

The microwave stirring means 7 includes stirring blades 8 disposed in the cavity 3, a driving motor 9 disposed outside the cavity 3, a rotation transmitting shaft 10 that transmits the rotation of the driving motor 9 to the stirring blades 8. The stirring blades 8 rotate to stir the atmosphere in the cavity 3.

Figure 9:
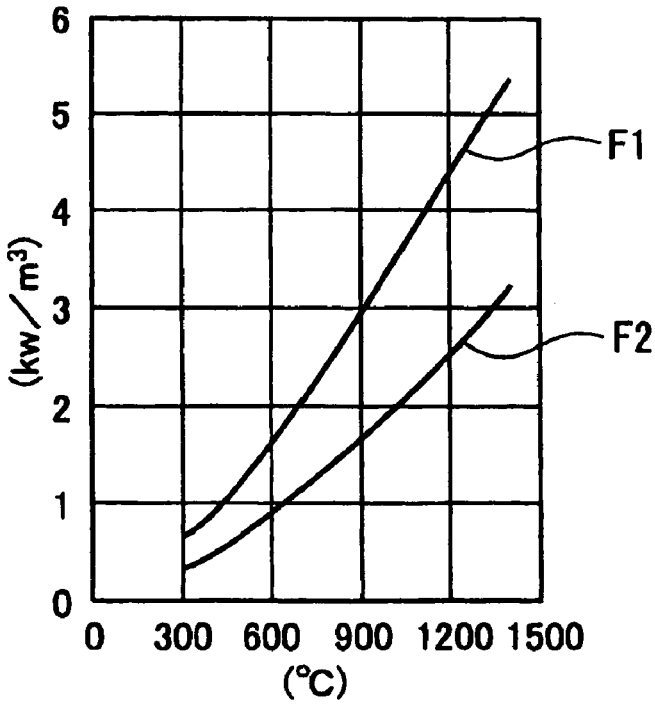
FIG. 9 is a graph plotting the change in the heating values from heating elements when the thickness of a heat-insulating partition wall composing an inner shell of the baking chamber of the microwave baking furnace shown in FIG. 1 is changed.

The partition wall 14 composed of the heat insulating member 15*a* partitions a baking chamber 12 that receives an object 11 to be baked. The heating elements 15*b* are provided on right and left surfaces of the baking chamber 12. The heat insulating member 15*a* composing the partition wall 14 is made of a material that insulates heat and allows transmission of microwaves, specifically, alumina fiber, foamed alumina, etc. As shown in FIG. 9, the partition wall 14 can suppress heat radiation to the outside from the baking chamber 12 or the heating elements 15*b* more effectively as the thickness thereof increases.

In FIG. 9, a curved line F1 represents a heat radiation characteristic in a case where the thickness of the partition wall 14 is small, and a curved line F2 represents a heat radiation characteristic in a case where the thickness of the partition wall 12 is increased as compared to that in the curved line F1. In addition, it is evident from the drawing that the partition wall 14 having an increased thickness can improve a heat insulating property. In addition, in FIG. 9, the horizontal axis represents the temperature of the baking chamber 12, and the vertical axis illustrates the amount of heat radiated from the baking chamber 12 to the outside.

With regard to the arrangement type of the heating elements 15*b* to the object 11 to be baked, in order to apply the heat generated by the heating elements 15*b* to the object 11 to be baked, the heating elements are arranged around the object 11 to be baked on the surfaces facing the object 11 to be baked. Although the number of the surfaces on which the heating elements 15*b* are arranged may be one or two, the more the number of the heating elements 15*b* is, the more uniformly the object 11 to be baked is heated. However, since heat can also be transferred in the baking furnace 12 by air circulation (not limited to natural convection) as well as radiation, the heating elements are not necessarily arranged on all six surfaces. The most practical way is to arrange the heating elements on five surfaces and to leave the remaining surface disposed nothing. The remaining surface may be opened to cause air circulation, or the heat insulating member 15*a* composed of a material that transmits microwaves, if necessary, and that does not self-heat may be disposed on the remaining surface. In addition, in FIG. 1, the heating elements 15*b* may be seen as if they are arranged in air within the baking chamber 12. However, since such arrangement is actually impossible, the heating elements can be held by putting fire-resistant filler having a low microwave loss into the surroundings thereof.

The substances (the heating elements) 15*b* having a high microwave loss includes materials that have heating value per unit volume by microwaves is several times to dozens of times that of a material composing the object 11 to be baked at room temperature and that show an excellent great microwave absorption characteristic in a high temperature range that is the baking temperature. For example, silicon carbide, silicon nitride, graphite and composites containing these as main components etc. can be used as the substances 15*b*.

According to the microwave baking furnace 1 described above, when the microwave oscillator (magnetron) 6 as a microwave generating means radiates microwaves to the heating elements (substances having a high microwave loss) 15*b*, the heating elements 15*b* rise in temperature by microwave heating, and at the same time, the object 11 to be baked in the baking chamber 12 defined by the partition wall 14 composed of the heat insulating member 15*a* rises in temperature by microwave heating by the microwaves transmitted through the heating elements 15*b*.

During such a baking process, in the temperature rise in a low temperature range by initial microwave heating, the substances (the heating elements) 15*b* having a high microwave loss generates heat at a high energy efficiency, to promote the rise in temperature of the surroundings. The substances 15*b* keeps heating at a high energy efficiency even when it rises up to a predetermined high temperature range, thereby raising the temperature of the surroundings.

Further, although a surface which does not face the heating elements 15*b* exists in the baking furnace 12, the interior of the baking chamber 12 is heated uniformly by air circulation by a temperature difference caused during the temperature rise. Moreover, the surface having no heating elements 15*b* also rises up to the baking temperature uniformly by the air circulation.

Therefore, the heating elements 15*b* can be efficiently heated only by the microwave heating, and the time taken to raise the temperature of heat the heating elements 15*b* from a low temperature range to a high temperature range can be shortened. Besides, even when alumina, silica, etc., that is main materials of ceramics having a low dielectric loss at room temperature, is used as the raw material of the object 11 to be baked, the baking process can be performed smoothly at a high efficiency.

Next, the positional relationship between the plurality of substances (heating elements) 15*b* having a high microwave loss will be described after the description of microwaves to be used in the present invention.

At the present, commercialized microwaves have a frequency of either 2.45 GHz or 0.915 GHz. The baking furnace 1 according to the present invention can be used not only for domestic microwave ovens having a frequency of 2.45 GHz but also for microwave ovens having a frequency of 0.915 GHz. In this case, it is preferable to manufacture the microwave baking furnace 1 after the area of an opening provided in the baking chamber 12 has been adjusted in advance in order to balance the heating amount of the object 11 to be baked by the radiant heating from the baking chamber wall 13 with the self-heating amount of the object 11 to be baked by microwave heating, to alleviate the temperature distribution in the thickness direction to prevent the occurrence of flaw. That is, for example, when the opening area is large, the object 11 to be baked absorbs more microwaves, and thus is further heated by microwaves, while portions that generate heat are decreased, and thus heating amount by radiation is decreased.

Meanwhile, the frequency of the microwaves is preferably in a range of 0.9 to 100 GHz, more preferably in a range of 0.9 to 10 GHz, and most preferably 2.45 GHz. When the frequency is below 0.9 GHz, the wavelength of the microwaves is too long, and the absorption rate of the microwaves decreases. On the contrary, when the frequency of the microwaves is over 100 GHz, an expensive microwave oscillator 6 is undesirably needed. When the frequency of the microwaves outputted from the microwave oscillator 6 is 2.45 GHz, a relatively small and cheap microwave oscillator 7 can work satisfactorily.

Also, when the frequency of the microwaves is 2.45 GHz, the wavelength of the microwaves is about 122 mm, whose half is 61 mm. Therefore, the heating elements composed of the substances 15*b* having a high microwave loss are arranged with intervals of no less than 61 mm×n therebetween. With this arrangement, the surfaces and the interior of the object to be baked 21 can be heated uniformly, and the occurrence of flaw in the object 11 to be baked can be prevented efficiently.

Figure 2:
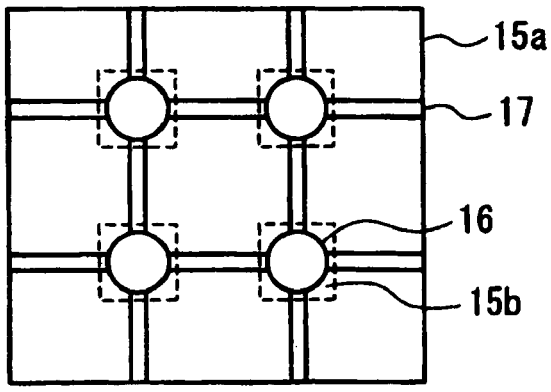
FIG. 2 is a front view illustrating the structure of a heat insulating member in which substances having a high microwave loss are buried, and holes and grooves that guide radiant heat are formed.
Figure 3:
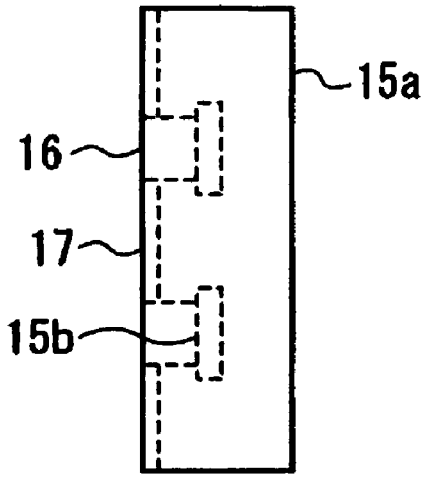
FIG. 3 is a side view illustrating the structure of the heat insulating member in which the substances having a high microwave loss are buried and the holes and grooves that guide radiant heat are formed.

FIGS. 2 and 3 are a front view and a side view of the microwave baking furnace 1 according to an embodiment of the present invention in which holes 16 and grooves 17 that guide radiant heat from the substances (heating elements) 15*b* having a high microwave loss to the baking chamber wall 13 are formed in a heat insulating member 15*a*.

In this case, the substances (heating elements) 15*b* having a high microwave loss are arranged to be buried in the heat insulating member 15*a*. In addition, when the substances 15*b* are arranged to be buried in the heat insulating member 15*a*, the holes 16 and the grooves 17 are arranged toward the outside of the baking chamber wall 13. This arrangement is advantageous in that it makes the interior temperature of the baking chamber uniform.

Figure 4:
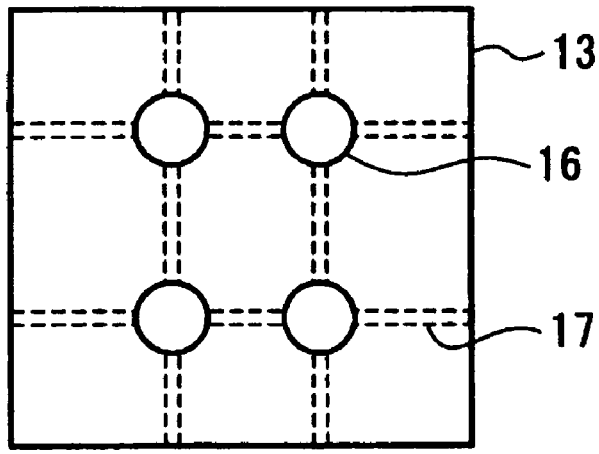
FIG. 4 is a front view illustrating the structure of a baking chamber wall in which the holes and the grooves that guide the radiant heat are formed.
Figure 5:
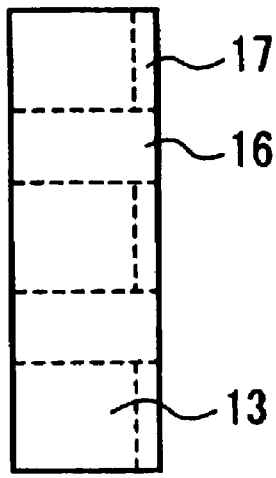
FIG. 5 is a side view illustrating the structure of the baking chamber wall in which the holes and the grooves that guide the radiant heat are formed.
Figure 6:
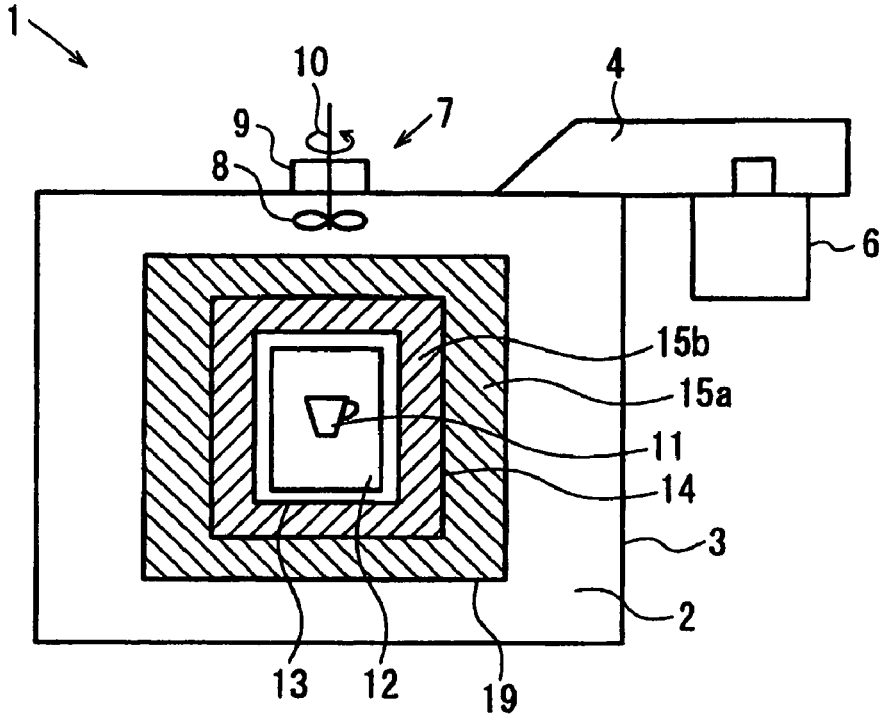
FIG. 6 is a schematic view illustrating the structure of a conventional microwave baking furnace in which substances having a high microwave loss surround a baking chamber.
Figure 7:
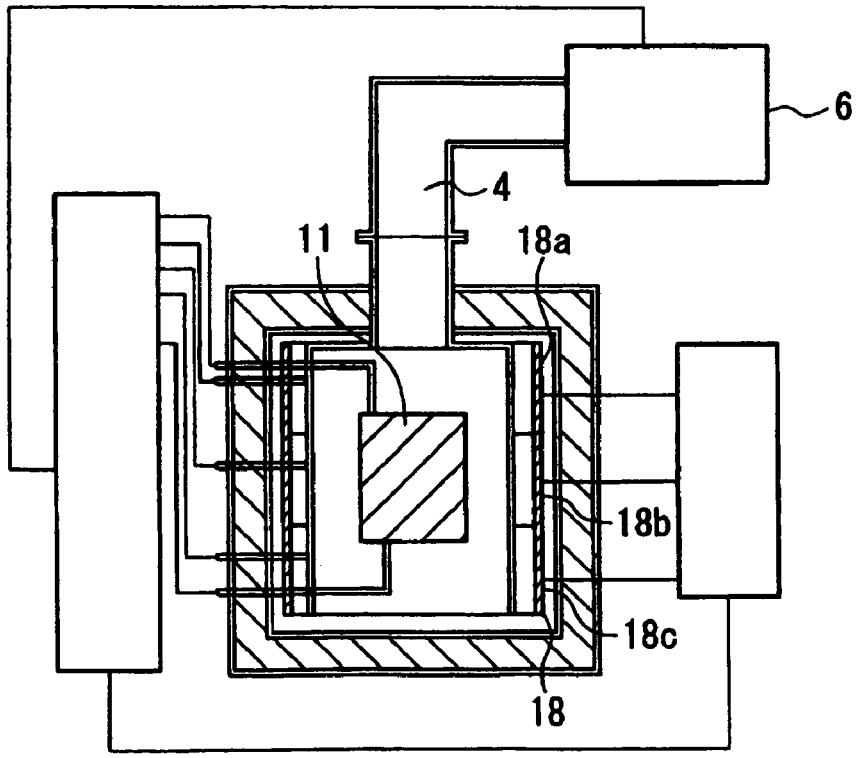
FIG. 7 is a schematic view illustrating the structure of a conventional microwave baking furnace in which a heater is disposed.
Figure 8:
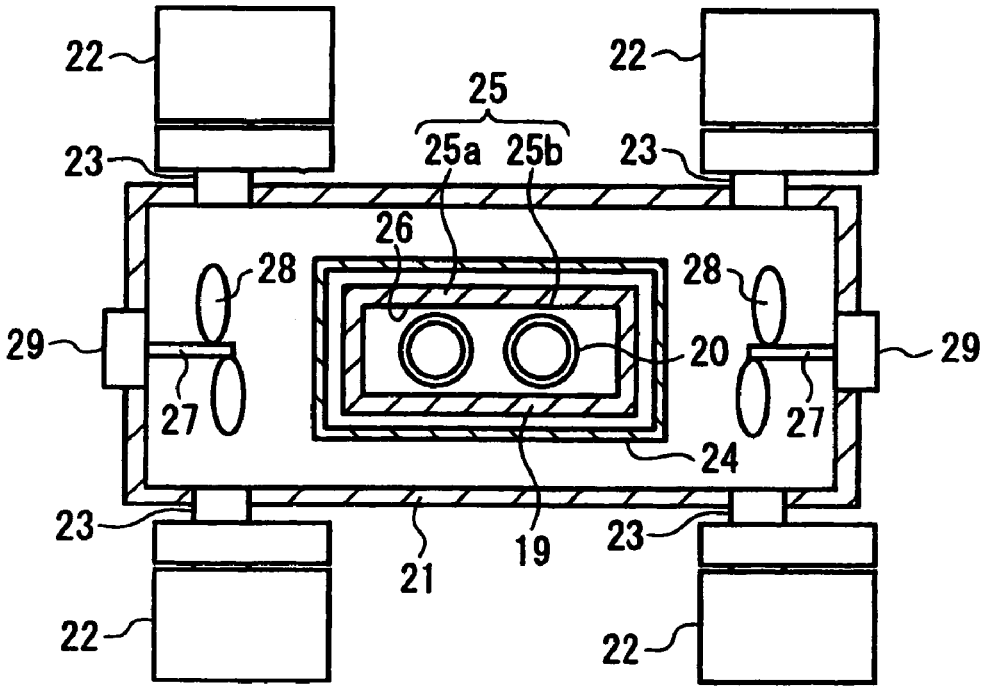
FIG. 8 is a schematic view illustrating the structure of a conventional microwave baking furnace in which a blanket of heating elements that surround an object to be baked and self-heat by microwaves are provided.

FIGS. 4 and 5 are a front view and a side view of the microwave baking furnace according to another embodiment of the present invention in which the holes 16 and the grooves 17 that guide radiant heat from the substances 15*b* having a high microwave loss to the interior of the baking chamber 12 are formed in a baking furnace wall 28.

In both cases of FIGS. 2 to 3 and FIGS. 4 to 5, the substances 15*b* having a high microwave loss, such as silicon carbide, arranged in the heat insulating member 15*a* or between the heat insulating member 15*a* and the baking chamber wall 13 can guide radiant heat generated by microwave radiation to the interior of the baking chamber 12 efficiently through the holes 16 or the grooves 17, and thus can raise the interior temperature of the baking chamber 12 uniformly and rapidly.

In the following embodiment, the heating elements 15*b* such as silicon carbide can be arranged with an amount of less than 40 g/kW at their maximum microwave output.

If more than 40 g/kW of the heating elements 15*b* such as silicon carbide is inserted into the inside of the heat insulating member 15*a*, the ratio in which the microwaves the heat silicon carbide increases, the ratio in which the microwaves heat the object 11 to be baked decreases, the use efficiency of the microwaves decreases, and a temperature difference is caused between the interior of the baking chamber 12 and the object 11 to be baked, which causes flaw on the surfaces of the object 11 to be baked. Therefore, it is very effective to suppress the amount of the heating elements 15*b*, such as silicon carbide, to be arranged to an amount of less than 40 g/kW at their maximum microwave output in order to prevent occurrence of flaw or crack in an object to be baked.

According to the microwave baking furnace of the present invention, when an object to be baked is heated by microwaves, it is possible to uniformly heat and bake an object to be baked without causing a temperature gradient in the object to be baked, and it is possible to prevent the occurrence of flaw or crack in the object to be baked. As a result, the microwave baking furnace can be used to bake potteries or ceramics.

What is claimed is:

1. A microwave baking furnace, comprising:

a metallic cavity, irradiated with microwaves;

a baking chamber, surrounded by a heat insulating member having a low microwave absorption characteristic and a high heat insulating property disposed in the cavity; and a microwave generator;

wherein substances having a high microwave loss are arranged in weak microwave electric field areas of the baking chamber at a distance, which exceeds ¼ of a wavelength λ of microwaves to be used, from the metallic cavity, and wherein the substances having a high microwave loss are arranged with an amount of less than 40 g/kW at their maximum microwave output.

2. The microwave baking furnace according to claim 1, wherein the substances having a high microwave loss are arranged on left, right, top and bottom of the baking chamber with a distance therebetween, in which the distance is equal to ½×n (n is a natural number) of the wavelength λ of the microwaves to be used.

3. The microwave baking furnace according to claim 1, wherein the substances having a high microwave loss are arranged inside a heat insulating member that transmits microwaves and the heat insulating member is formed with holes or grooves to guide radiant heat from the substances having a high microwave loss to an outer wall of the baking chamber.

4. The microwave baking furnace according to claim 1, wherein holes or grooves to guide radiant heat from the substances having a high microwave loss to the inside of the baking chamber are formed and arranged on the outer wall of the baking chamber.

5. The microwave baking furnace according to claim 1, wherein the substances having a high microwave loss are selected from one of silicon carbide, silicon nitride, graphite, and composites containing these as main components.

* * * * *